US012054860B1

(12) United States Patent
Chen

(10) Patent No.: US 12,054,860 B1
(45) Date of Patent: Aug. 6, 2024

(54) BEAD COLLECTION APPARATUS

(71) Applicant: Shenzhen Youbaisite e-commerce Co., Ltd., Shenzhen (CN)

(72) Inventor: Yi Chen, Shenzhen (CN)

(73) Assignee: Shenzhen Youbaisite e-commerce Co., Ltd., Shenzhen (CN)

( * ) Notice: Subject to any disclaimer, the term of this patent is extended or adjusted under 35 U.S.C. 154(b) by 0 days.

(21) Appl. No.: 18/405,758

(22) Filed: Jan. 5, 2024

(30) Foreign Application Priority Data

Dec. 29, 2023 (CN) ..... 202323646156.0

(51) Int. Cl.
*D04D 9/00* (2006.01)
*D04D 1/04* (2006.01)
*A63H 3/00* (2006.01)

(52) U.S. Cl.
CPC ..... *D04D 9/00* (2013.01); *D04D 1/04* (2013.01); *A63H 3/003* (2013.01)

(58) Field of Classification Search
CPC . D04D 9/00; D04D 11/00; D04D 1/04; A63H 3/003; D05C 13/00; D05C 7/08
See application file for complete search history.

(56) References Cited

U.S. PATENT DOCUMENTS

| | | | | | |
|---|---|---|---|---|---|
| 2,088,865 | A * | 8/1937 | McRoskey | ..... | A41H 37/10 112/108 |
| 2,670,109 | A * | 2/1954 | Perry | ..... | D04D 1/04 223/48 |
| 4,280,266 | A * | 7/1981 | Tomita | ..... | D04D 1/04 29/241 |
| 2006/0085960 | A1 * | 4/2006 | O'Keefe | ..... | D04D 1/04 29/241 |

FOREIGN PATENT DOCUMENTS

| | | | | | |
|---|---|---|---|---|---|
| CN | 202478551 | U | | 10/2012 | |
| CN | 210117505 | U | | 2/2020 | |
| CN | 113892739 | A | * | 1/2022 | |
| CN | 216456899 | U | | 5/2022 | |
| CN | 217695478 | U | * | 11/2022 | |
| WO | WO-2019052089 | A1 | * | 3/2019 | ..... D05C 7/08 |

* cited by examiner

*Primary Examiner* — Ismael Izaguirre
(74) *Attorney, Agent, or Firm* — Nitin Kaushik

(57) ABSTRACT

The present disclosure relates to the field of automatic bead collection technologies and discloses an efficient bead collection apparatus simple and convenient to operate, including a main body (100), a driving assembly (700), a rotating assembly (300), and a bead stringing assembly (500), where the driving assembly (700) acts to drive the rotating assembly (300) to rotate, and blade assemblies (310*b*, 320*b*) cyclically rotate/disperse beads (800) in the rotating assembly (300), such that the beads (800) fall into the bead stringing assembly (500) by gravity.

17 Claims, 13 Drawing Sheets

BEAD COLLECTION APPARATUS

CROSS-REFERENCE TO RELATED APPLICATIONS

The application claims priority to Chinese patent application No. 202323646156.0, filed on Dec. 29, 2023, the entire contents of which are incorporated herein by reference.

TECHNICAL FIELD

The present disclosure relates to the field of automatic bead collection technologies, and more specifically, to a bead collection apparatus.

BACKGROUND

Bracelets/necklaces/earrings are decorative items often used in people's daily lives. Collection of beads on bracelets/necklaces/earrings is a necessary step in factory production/personal DIY. In the prior art, equipment in this regard is predominantly manual/semi-automatic. Due to small beads/apertures of bracelets/necklaces/earrings, especially for personal DIY, there is no large rotating machine in the factory, and common bead stringing equipment is difficult to operate and incapable of conveniently and quickly collecting the beads and stringing them into the bracelets/necklaces/earrings, resulting in low efficiency and complex operation of the entire bead stringing/collection process and time-consuming processing step.

Therefore, how to improve the efficiency and convenience of the bead stringing process has become an urgent problem to be solved by those skilled in the art.

SUMMARY

For the deficiencies in the prior art that due to small beads/apertures of bracelets/necklaces/earrings, especially for personal DIY, there is no large rotating machine in the factory, resulting in low efficiency and complex operation of the entire bead stringing/collection process and time-consuming processing step, the present disclosure provides an efficient bead collection apparatus simple and convenient to operate.

To solve the technical problem, the present disclosure adopts the following technical solution: a bead collection apparatus is constructed, including:

a main body;

a driving assembly fixed to the main body and configured to output a rotating torque;

a rotating assembly provided with an opening in one end and configured to place beads to be collected, where one end of an axis of the opening of the rotating assembly is rotatably connected to the driving assembly, and a plurality of blade assemblies are radially arranged in the rotating assembly;

a bead stringing assembly with one end extending into the rotating assembly through the opening;

where the driving assembly acts to drive the rotating assembly to rotate, and the blade assemblies cyclically rotate/disperse the beads in the rotating assembly, such that the beads fall into the bead stringing assembly by gravity.

In some embodiments, an inclination of the rotating assembly is set to 10-20°.

In some embodiments, the rotating assembly includes a first inner disc and a second inner disc, and the first inner disc and the second inner disc are detachably arranged.

In some embodiments, a connecting hole is provided in a rear end surface of the first inner disc, and a rotating shaft of the driving assembly is embedded into the connecting hole of the first inner disc and is capable of being in transmission connection with the first inner disc.

In some embodiments, a plurality of first blades are radially arranged in the first inner disc, and a plurality of second blades corresponding to the first blades are radially arranged in the second inner disc.

In some embodiments, grooves are provided in upper end surfaces of the first blades, convex ribs are arranged on upper end surfaces of the second blades, and when the first inner disc is matched with the second inner disc, the convex ribs on the second blades are embedded into the grooves of the first blades.

In some embodiments, one end of the bead stringing assembly is arranged in an upper end of the rotating assembly in a suspended manner.

In some embodiments, the bead stringing assembly has one end in a bent shape and the other end in a Z shape.

In some embodiments, the apparatus further includes a base, where a fixing slot is provided in an upper end surface of the base, and the Z-shaped end of the bead stringing assembly is fixed in the fixing slot of the base.

In some embodiments, the main body includes a first housing and a second housing that are of a hollow structure, and an open end of the first housing is matched with an open end of the second housing.

In some embodiments, the apparatus further includes an outer disc body that is of a hollow structure, where the rotating assembly is arranged in the outer disc body.

In some embodiments, an inner wall of the outer disc body is spaced apart from an outer wall of the rotating assembly, and the rotating assembly is rotatable relative to the outer disc body.

In some embodiments, the outer disc body includes a first outer disc and a second outer disc, and the first outer disc and the second outer disc are detachably arranged.

In some embodiments, a connecting end surface is arranged at an upper end of the second housing, and the connecting end surface is fixedly matched with an outer end surface of the first outer disc.

In some embodiments, the driving assembly is arranged on an inner side of the connecting end surface of the second housing through a fixing part.

In some embodiments, the rotating shaft of the driving assembly is embedded into the connecting hole of the first inner disc through a through hole of the connecting end surface and a through hole of the first outer disc.

The bead collection apparatus according to the present disclosure includes the main body, the driving assembly, the rotating assembly, and the bead stringing assembly, where the driving assembly acts to drive the rotating assembly to rotate, and the blade assemblies cyclically rotate/disperse the beads in the rotating assembly, such that the beads fall into the bead stringing assembly by gravity. Compared with the prior art, when the driving assembly rotates, the rotating assembly is driven to rotate, and the blade assemblies cyclically rotate the beads, such that the beads may fall into the bead stringing assembly by gravity, thereby improving the bead collection efficiency to a certain extent, and implementing faster and more convenient collection of the beads. There is no need for too much manual operation during bead collection, which can free the hands to the greatest extent.

BRIEF DESCRIPTION OF DRAWINGS

The present disclosure is further described below with reference to the accompanying drawings and embodiments. In the drawings.

DETAILED DESCRIPTION OF THE EMBODIMENTS

Figure 1:
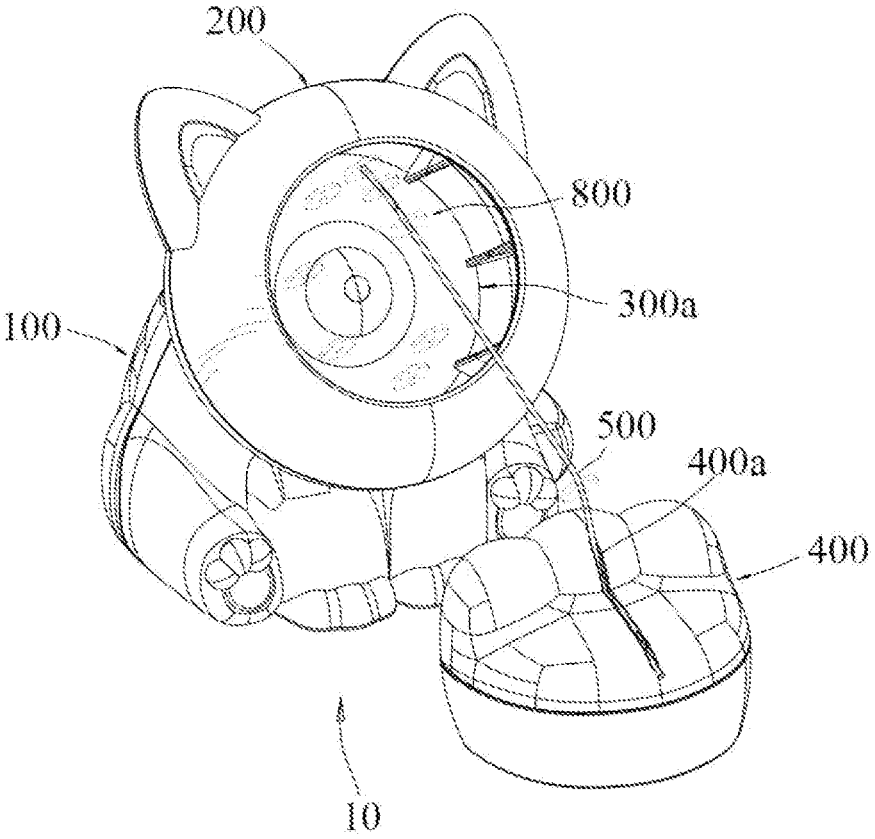
FIG. 1 is a schematic three-dimensional view of an embodiment of a bead collection apparatus provided by the present disclosure.

To understand the technical features, objective, and effects of the present disclosure more clearly, specific embodiments of the present disclosure are now described in detail with reference to the accompanying drawings.

As shown in FIG. 1 to FIG. 4, in a first embodiment of a bead collection apparatus according to the present disclosure, the bead collection apparatus 10 includes a main body 100, an outer disc body 200, a rotating assembly 300, a base 400, a bead stringing assembly 500, a fixing part 600, and a driving assembly 700.

The main body 100 is formed into a hollow structure and is configured to bear the outer disc body 200, the rotating assembly 300, the fixing part 600, and the driving assembly 700.

The outer disc body 200 is formed into a circular structure with an opening in one end, is fixed to an upper part of the main body 100, and is configured to place the rotating assembly 300.

The rotating assembly 300 is formed into a circular structure with an opening in one end and is configured to place beads 800 to be collected.

The bead stringing assembly 500 is of a cylindrical structure and is configured to collect the beads 800 in the rotating assembly 300.

The fixing part 600 is a cylinder of a penetration structure 610, is fixed in the main body 100, and is configured to fix the driving assembly 700.

The driving assembly 700 is configured to provide a rotating torque to drive the rotating assembly 300 to rotate.

At least one through hole for the bead stringing assembly 500 to penetrate through is provided in a periphery or middle of each bead 800.

Specifically, the main body 100 is configured to bear or place the outer disc body 200, the rotating assembly 300, the fixing part 600, and the driving assembly 700.

The driving assembly 700 is fixed to the main body 100 and configured to output the rotating torque.

The driving assembly 700 may be a motor.

Figure 5:
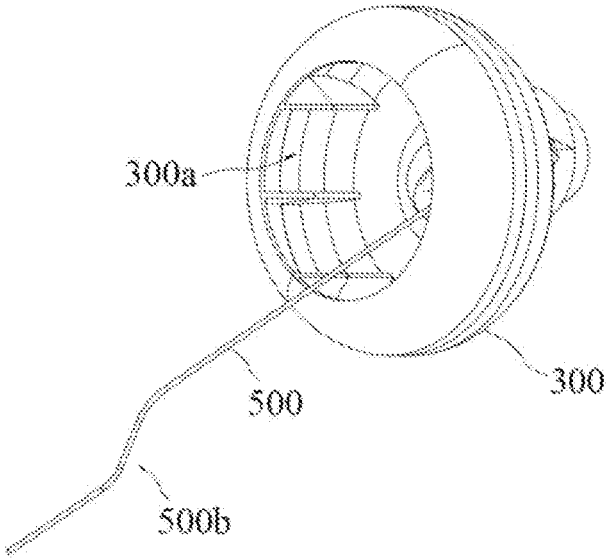
FIG. 5 is a schematic three-dimensional view of an embodiment of a rotating assembly provided by the present disclosure.

Further, as shown in FIG. 5, the rotating assembly 300 is provided with the opening 300*a* in one end and configured to place the beads 800 to be collected, where one end of an axis of the opening 300*a* of the rotating assembly 300 is rotatably connected to the driving assembly 700, and the driving assembly 700 rotates to drive the rotating assembly 300 to rotate.

Figure 4:
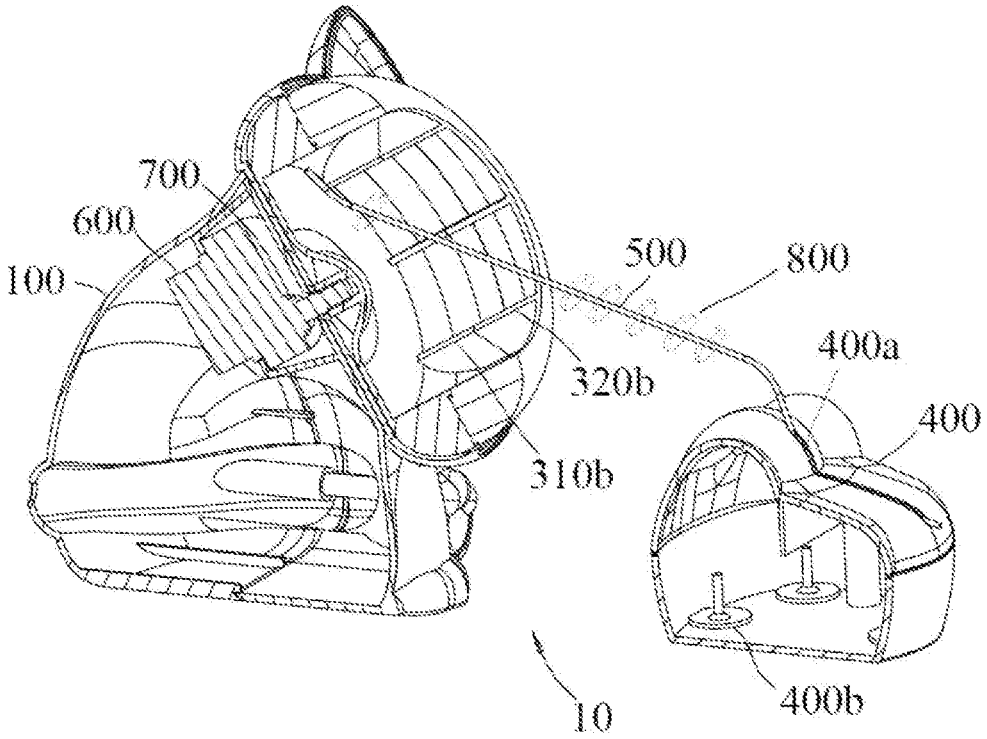
FIG. 4 is a sectional view of an embodiment of a bead collection apparatus provided by the present disclosure.

As shown in FIG. 4, a plurality of blade assemblies (310*b* and 320*b*) are radially arranged in the rotating assembly 300.

where there are at least six or more blade assemblies (310*b* and 320*b*) arranged equidistantly or non-equidistantly.

As shown in FIG. 4, one end of the bead stringing assembly 500 extends into the rotating assembly 300 through the opening 300*a*.

Specifically, the plurality of beads 800 are placed into the rotating assembly 300; when power is on, the driving assembly 700 acts to drive the rotating assembly 300 to rotate (clockwise/counterclockwise), and the blade assemblies (310*b* and 320*b*) rotate with the rotating assembly 300, such that the beads 800 in the rotating assembly 300 are cyclically rotated/dispersed; and when the beads 800 are brought to a high point by the blade assemblies (310*b* and 320*b*), the beads 800 fall by gravity and are randomly strung into the bead stringing assembly 500.

With this technical solution, when the driving assembly 700 rotates, the rotating assembly 300 is driven to rotate, and the blade assemblies (310*b* and 320*b*) cyclically rotate the beads 800, such that the beads 800 may fall into the bead stringing assembly 500 by gravity, thereby improving the bead collection efficiency to a certain extent, and implementing faster and more convenient collection of the beads. There is no need for too much manual operation during bead collection, which can free the hands to the greatest extent.

In some embodiments, as shown in FIG. 4, in order to collect the beads more quickly and conveniently, an inclination of the rotating assembly 300 is set to 10-20°. The driving assembly 700 drives the rotating assembly 300 to rotate, such that the beads 800 fall into the bead stringing assembly 500 by gravity.

In some embodiments, as shown in FIG. 2, FIG. 3, FIG. 6, FIG. 10, and FIG. 11, in order to improve the convenience of assembly, the rotating assembly 300 may include a first inner disc 310 and a second inner disc 320, where the first inner disc 310 is set to be of a structure 310*a* with an opening in one end, the second inner disc 320 is set to be of a penetration structure 320*a*, the opening structure 310*a* of the first inner disc 310 is matched with the penetration structure 320*a* of the second inner disc 320, and the first inner disc and the second inner disc are detachably arranged.

Figure 6:
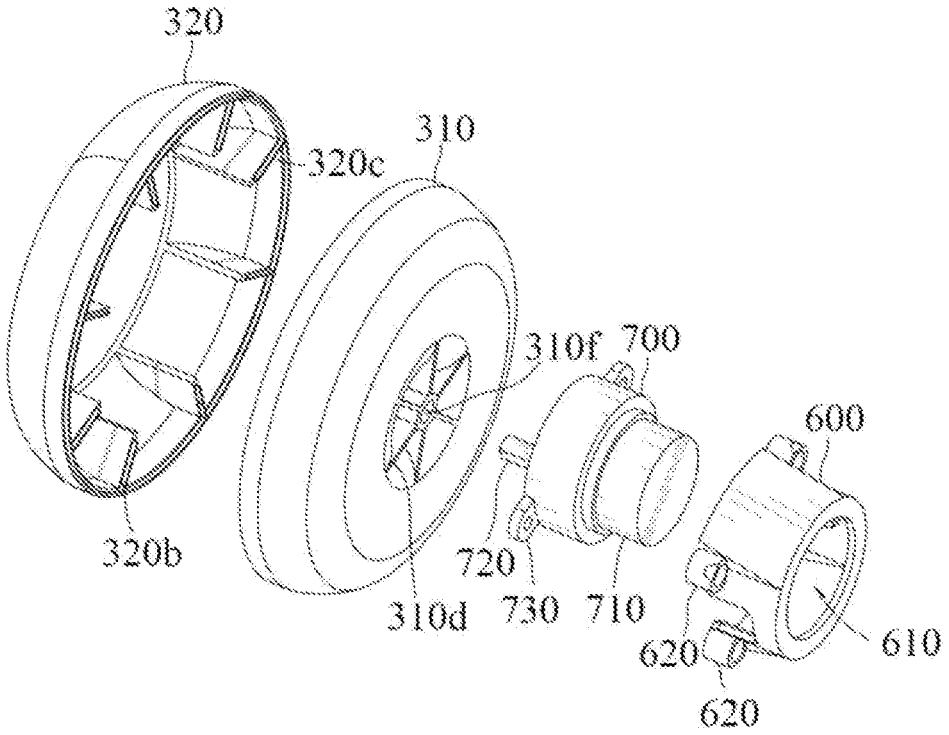
FIG. 6 is a schematic exploded view of an embodiment of a rotating assembly and a driving assembly provided by the present disclosure.

In some embodiments, as shown in FIG. 6, in order to improve the reliability of connection between the first inner disc 310 and the driving assembly 700, a connecting hole 310*f* may be provided in a bulge 310*d* on a rear end surface of the first inner disc 310, and a rotating shaft 720 of the driving assembly 700 is embedded into the connecting hole 310*f* of the first inner disc 310 and is capable of being in transmission connection with the first inner disc 310.

Figure 10:
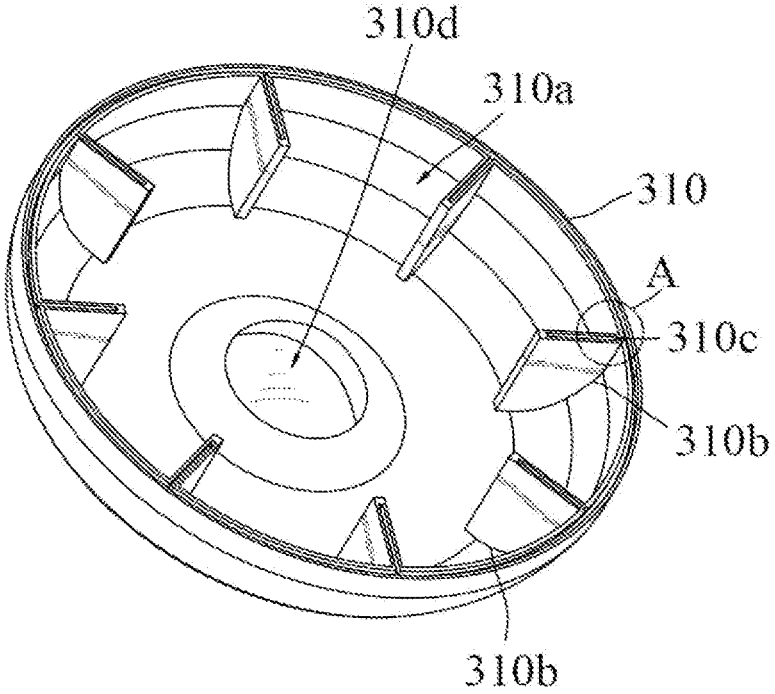
FIG. 10 is a schematic three-dimensional view of an embodiment of a first inner disc provided by the present disclosure.
Figure 11:
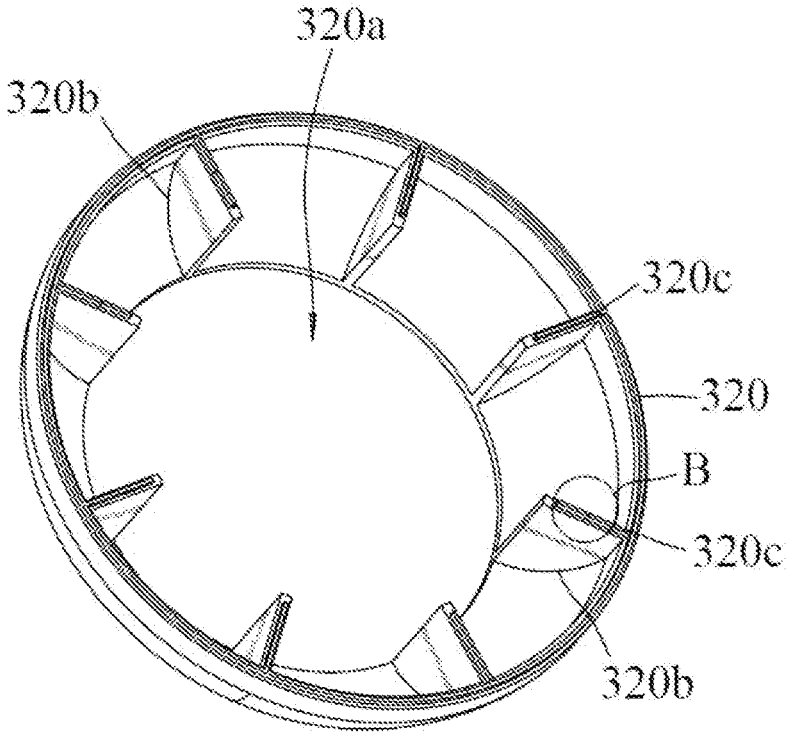
FIG. 11 is a schematic three-dimensional view of an embodiment of a second inner disc provided by the present disclosure.
Figure 12:
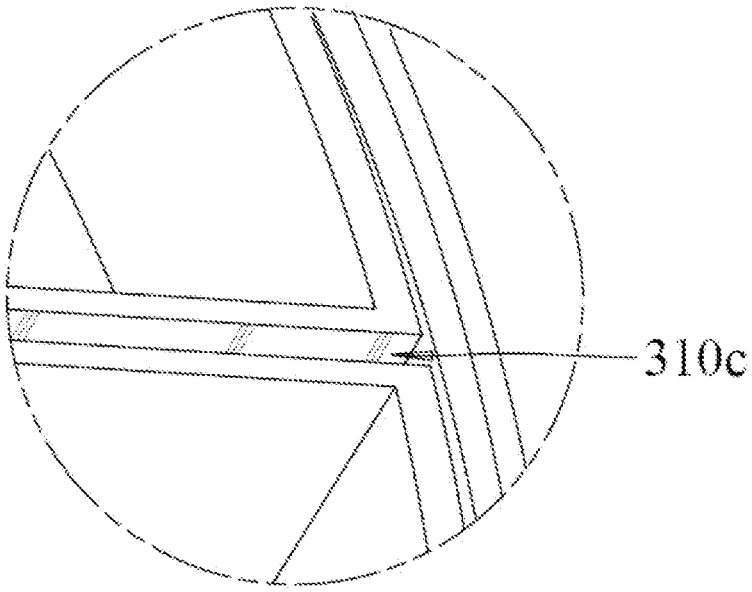
FIG. 12 is a schematic enlarged view of A in FIG. 8.
Figure 13:
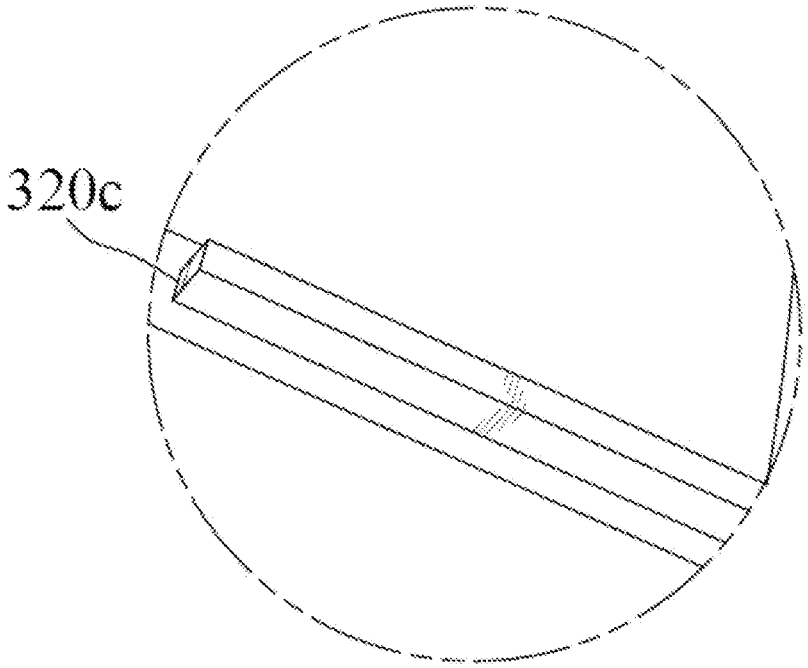
FIG. 13 is a schematic enlarged view of B in FIG. 9.

In some embodiments, as shown in FIG. 10 and FIG. 11, a plurality of first blades 310*b* are radially arranged in the first inner disc 310, a plurality of second blades 320*b* corresponding to the first blades 310*b* are radially arranged in the second inner disc 320, and when the first inner disc 310 is matched with the second inner disc 320, the first blades 310*b* are correspondingly matched with the second inner disc 320.

In some embodiments, as shown in FIG. 10 to FIG. 13, grooves 310*c* are provided in upper end surfaces of the first blades 310*b*, convex ribs 320*c* corresponding to the grooves 310*c* are arranged on upper end surfaces of the second blades 320*b*, and when the first inner disc 310 is matched with the second inner disc 320, the convex ribs 320*c* on the second blades 320*b* are embedded into the grooves 310*c* of the first blades 310*b*, such that the first inner disc 310 is matched with the second inner disc 320 more stably, thereby improving its reliability of operation.

In some embodiments, as shown in FIG. 4, one end of the bead stringing assembly 500 is arranged in an upper end of the rotating assembly 300 in a suspended manner.

Figure 8:
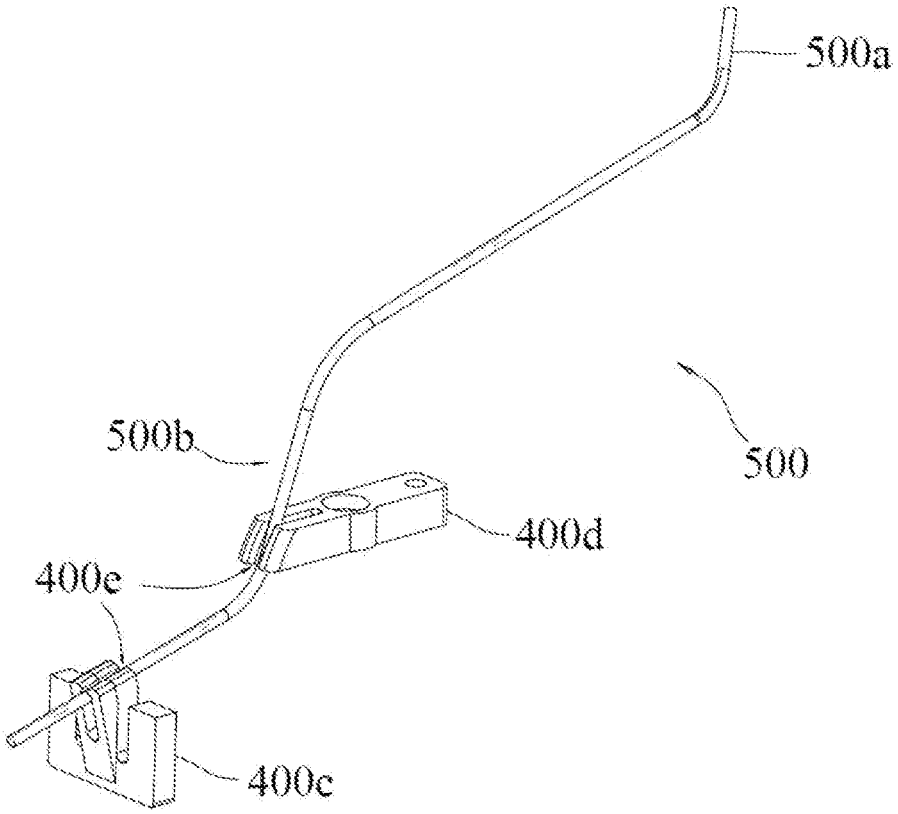
FIG. 8 is a schematic three-dimensional view of an embodiment of a bead stringing assembly and a fixing part provided by the present disclosure.
Figure 9:
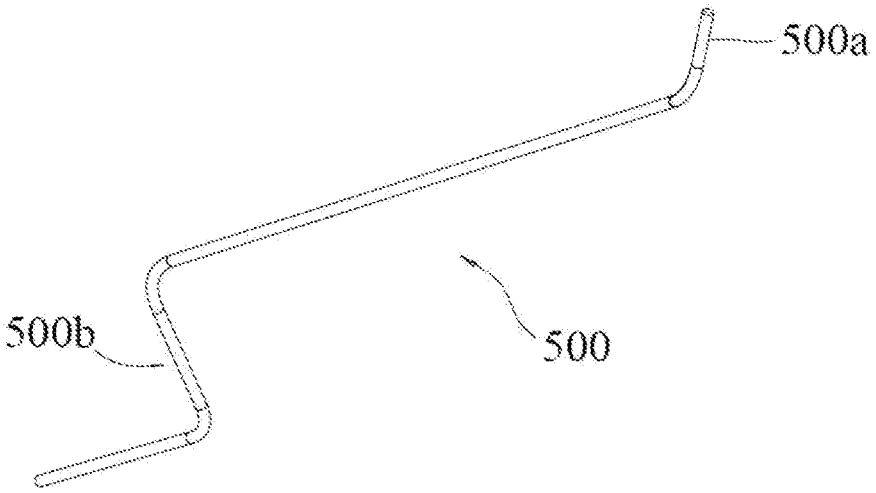
FIG. 9 is a schematic three-dimensional view of an embodiment of a bead stringing assembly provided by the present disclosure.

In some embodiments, as shown in FIG. 8 and FIG. 9, the bead stringing assembly 500 has one end in a bent shape and the other end in a Z shape, where the bent end of the bead stringing assembly 500 is placed in the rotating assembly 300.

In some embodiments, as shown in FIG. 4, the apparatus further includes a base 400, where a fixing slot 400*a* is provided in an upper end surface of the base 400, a plurality of silica gel anti-slip pads 400*b* are mounted at a bottom of the base 400, the silica gel anti-slip pads 400*b* and the base 400 are detachably arranged, and the placement stability of the base 400 is improved through the silica gel anti-slip pads 400*b*.

Figure 7:
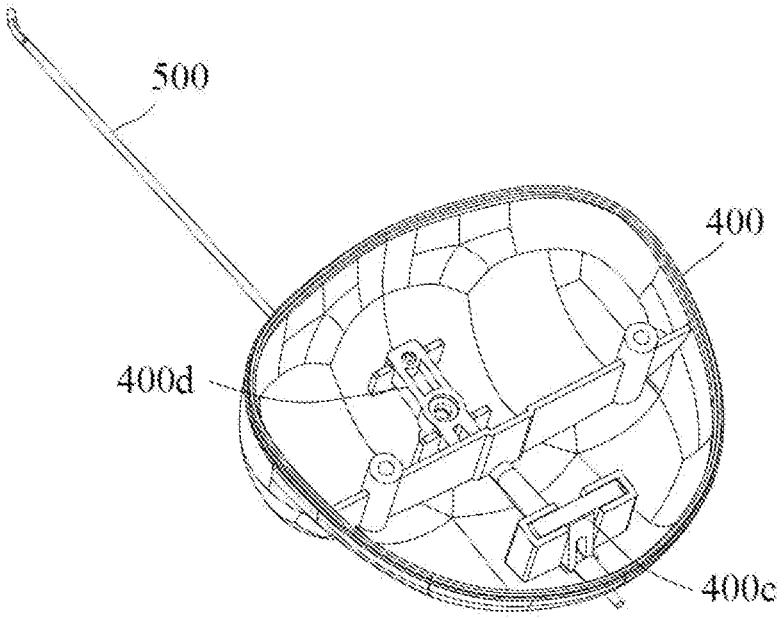
FIG. 7 is a schematic three-dimensional view of an embodiment of a base provided by the present disclosure.

As shown in FIG. 7, further, a first fixing part 400*c* and a second fixing part 400*d* are arranged in the fixing slot 400*a*.

As shown in FIG. 8, each of the first fixing part 400*c* and the second fixing part 400*d* is provided with an opening 400*e*.

The Z-shaped end 500*b* of the bead stringing assembly 500 is fixed in the openings 400*e* of the first fixing part 400*c* and the second fixing part 400*d* in the fixing slot 400*a* of the base 400. The Z-shaped end 500*b* of the bead stringing assembly 500 is clamped by the openings 400*e* of the first fixing part 400*c* and the second fixing part 400*d*, thereby improving the stability of the bead stringing assembly 500. Moreover, the beads 800 strung into the bead stringing assembly 500 may be limited by the fixing slot 400*a*.

Figure 2:
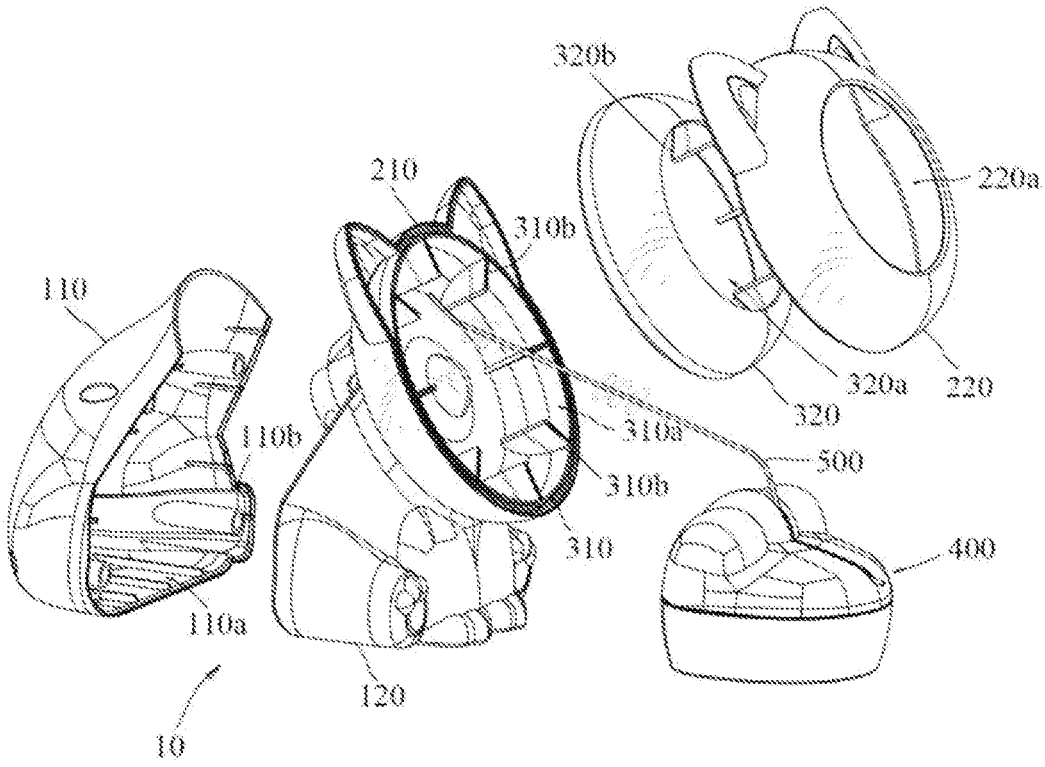
FIG. 2 is an exploded view of an embodiment of a bead collection apparatus provided by the present disclosure.
Figure 3:
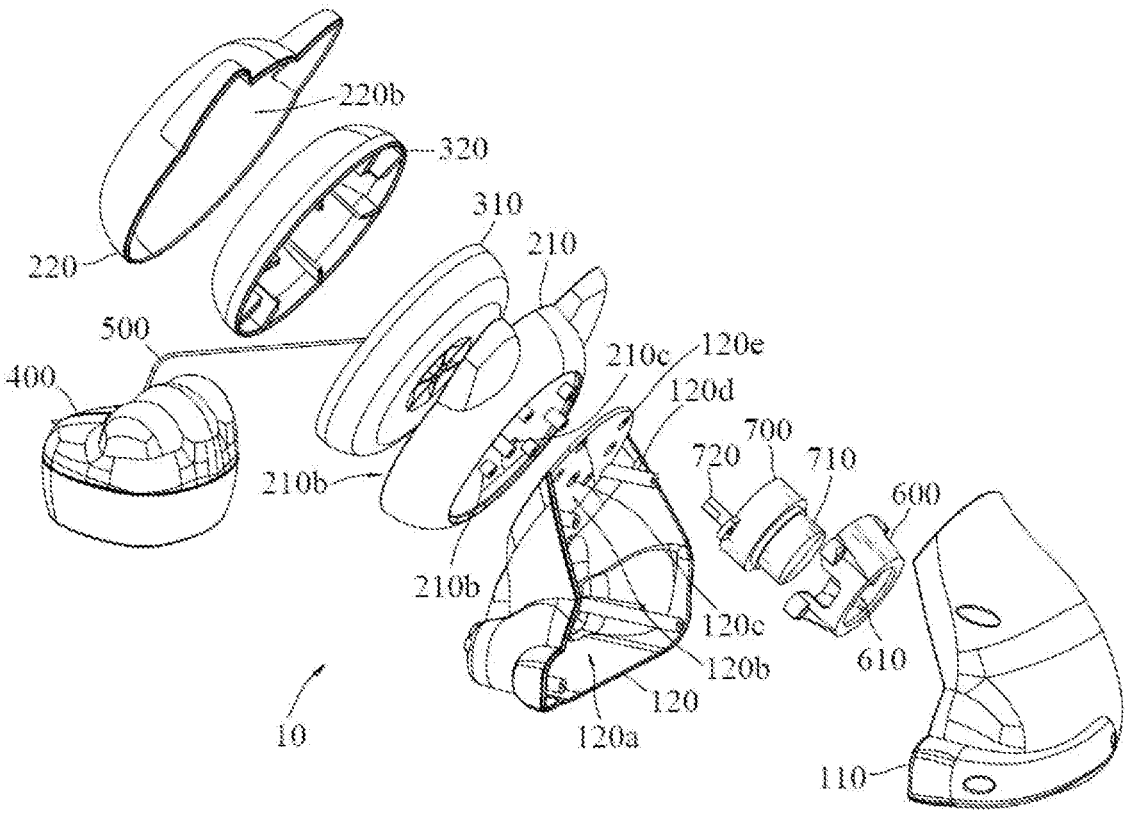
FIG. 3 is another exploded view of an embodiment of a bead collection apparatus provided by the present disclosure.

In some embodiments, as shown in FIG. 2 and FIG. 3, the main body 100 includes a first housing 110 and a second housing 120 that are of a hollow structure, and an open end 110*a* of the first housing 110 is matched with an open end 120*a* of the second housing 120 to form the hollow structure for placing the fixing part 600 and the driving assembly 700.

A first connecting rod 110*b* is arranged in the first housing 110, a second connecting rod 120*d* corresponding to the first connecting rod 110*b* is arranged in the second housing 120, and the first connecting rod 110*b* and the second connecting rod 120*d* are fixed by a lead screw, such that the first housing 110 is fixedly matched with the second housing 120.

In some embodiments, as shown in FIG. 3, in order to improve the operating reliability of the apparatus, the outer disc body 200 may be arranged in the apparatus. The outer disc body 200 is of a hollow structure (210*b* and 220*b*), and the rotating assembly 300 is arranged in the outer disc body 200.

An inner wall of the outer disc body 200 is spaced apart from an outer wall of the rotating assembly 300 by a gap of at least 2-5 mm.

The rotating assembly 300 is rotatable relative to the outer disc body 200.

Specifically, the outer disc body 200 is fixed to the main body 100, and the rotating assembly 300 is embedded into the outer disc body 200. When the driving assembly 700 rotates, the outer disc body 200 remains stationary, and the rotating assembly 300 rotates. When the apparatus operates, the influence of the outer disc body 200 on people around is avoided, thereby improving the operating safety of the apparatus.

In some embodiments, as shown in FIG. 3, the outer disc body 200 includes a first outer disc 210 and a second outer disc 220, where the first outer disc 210 and the second outer disc 220 are detachably arranged, and the second outer disc 220 is set to be of a penetration structure 220*a*.

In some embodiments, as shown in FIG. 3, a connecting end surface 120*b* is arranged at an upper end of the second housing 120 and is fixedly matched with an outer end surface of the first outer disc 210.

A fixing column 210*b* is arranged on an attaching surface between the second outer disc 220 and the connecting end surface 120*b*. During matching, the fixing column 210*b* on the second outer disc 220 penetrates through a corresponding through hole 120*e* and then is fixed by a lead screw.

In some embodiments, as shown in FIG. 3, one end 710 of the driving assembly 700 is arranged on an inner side of the connecting end surface 120*b* of the second housing 120 through an opening 610 of the fixing part 600.

In some embodiments, as shown in FIG. 3 and FIG. 6, the rotating shaft 720 of the driving assembly 700 is embedded into the connecting hole 310*f* of the first inner disc 310 through a through hole 120*c* of the connecting end surface 120*b* and a through hole 210*c* of the first outer disc 210.

A connecting lug 730 is arranged on a periphery of the driving assembly 700, a connecting lug 620 is arranged on a periphery of the fixing part 600, one end 710 of the driving assembly 700 is embedded into the fixing part 600, and then a lead screw is used to penetrate through the connecting lug 730 and the connecting lug 620, such that the driving assembly 700 is fixed in the fixing part 600.

The embodiments of the present disclosure have been described above in conjunction with the accompanying drawings, but the present disclosure is not limited to the above specific embodiments. The above specific embodiments are only schematic and not restrictive. Under the inspiration of the present disclosure, those of ordinary skill in the art may also make many forms without departing from the scope of protection of the objective and claims of the present disclosure, all of which fall within the scope of protection of the present disclosure.

What is claimed is:

1. A bead collection apparatus, comprising:

a main body;

a driving assembly fixed to the main body and configured to output a rotating torque;

a rotating assembly provided with an opening in one end and configured to place beads to be collected, wherein one end of an axis of the opening of the rotating assembly is rotatably connected to the driving assembly, and a plurality of blade assemblies are radially arranged in the rotating assembly;

a bead stringing assembly with one end extending into the rotating assembly through the opening;

wherein the driving assembly acts to drive the rotating assembly to rotate, and the blade assemblies cyclically rotate/disperse the beads in the rotating assembly, such that the beads fall into the bead stringing assembly by gravity;

wherein the rotating assembly comprises a first inner disc and a second inner disc.

2. The bead collection apparatus according to claim 1, wherein an inclination of the rotating assembly is set to 10-20°.

3. The bead collection apparatus according to claim 1, wherein the first inner disc and the second inner disc are detachably arranged.

4. The bead collection apparatus according to claim 1, wherein a connecting hole is provided in a rear end surface of the first inner disc, and a rotating shaft of the driving assembly is embedded into the connecting hole of the first inner disc and is capable of being in transmission connection with the first inner disc.

5. The bead collection apparatus according to claim 1, wherein a plurality of first blades are radially arranged in the first inner disc, and a plurality of second blades corresponding to the first blades are radially arranged in the second inner disc.

6. The bead collection apparatus according to claim 5, wherein grooves are provided in upper end surfaces of the first blades, convex ribs are arranged on upper end surfaces of the second blades, and when the first inner disc is matched with the second inner disc, the convex ribs on the second blades are embedded into the grooves of the first blades.

7. The bead collection apparatus according to claim 1, wherein one end of the bead stringing assembly is arranged in an upper end of the rotating assembly in a suspended manner.

8. The bead collection apparatus according to claim 7, wherein the bead stringing assembly has one end in a bent shape and the other end in a Z shape.

9. The bead collection apparatus according to claim 8, further comprising a base, wherein a fixing slot is provided in an upper end surface of the base, and the Z-shaped end of the bead stringing assembly is fixed in the fixing slot of the base.

10. The bead collection apparatus according to claim 7, wherein the main body comprises a first housing and a second housing that are of a hollow structure, and an open end of the first housing is matched with an open end of the second housing.

11. The bead collection apparatus according to claim 10, further comprising an outer disc body that is of a hollow structure, wherein the rotating assembly is arranged in the outer disc body.

12. The bead collection apparatus according to claim 11, wherein an inner wall of the outer disc body is spaced apart from an outer wall of the rotating assembly, and the rotating assembly is rotatable relative to the outer disc body.

13. The bead collection apparatus according to claim 12, wherein the outer disc body comprises a first outer disc and a second outer disc, and the first outer disc and the second outer disc are detachably arranged.

14. The bead collection apparatus according to claim 13, wherein a connecting end surface is arranged at an upper end of the second housing, and the connecting end surface is fixedly matched with an outer end surface of the first outer disc.

15. The bead collection apparatus according to claim 14, wherein the driving assembly is arranged on an inner side of the connecting end surface of the second housing through a fixing part.

16. The bead collection apparatus according to claim 15, wherein the rotating shaft of the driving assembly is embedded into the connecting hole of the first inner disc through a through hole of the connecting end surface and a through hole of the first outer disc.

17. The bead collection apparatus according to claim 12, wherein the outer disc body comprises a first outer disc and a second outer disc.

* * * * *